US005738414A

United States Patent [19]

Wieland et al.

[11] Patent Number: 5,738,414

[45] Date of Patent: Apr. 14, 1998

[54] MODULAR FURNITURE WITH INTERLOCKING COMPONENTS

[75] Inventors: Roy M. Wieland, Fort Wayne; Joel D. Alberda, Leo; Donald E. Neufer, Auburn, all of Ind.

[73] Assignee: R.M. Wieland Company, Inc., Grabill, Ind.

[21] Appl. No.: 618,465

[22] Filed: Mar. 15, 1996

[51] Int. Cl.[6] ..... A47C 7/00

[52] U.S. Cl. ..... 297/440.1; 297/440.23; 297/219.1

[58] Field of Search ..... 297/440.1, 440.11, 297/440.13, 440.14, 440.15, 440.16, 440.2, 440.21, 440.23, 218.2, 219.1, 228.13

[56] References Cited

U.S. PATENT DOCUMENTS

| | | | |
|---|---|---|---|
| 1,695,101 | 12/1928 | Hoffman . | |
| 2,605,820 | 8/1952 | Powellek . | |
| 3,074,762 | 1/1963 | Kris . | |
| 3,545,625 | 12/1970 | MacMillan . | |
| 3,608,959 | 9/1971 | Sarvas . | |
| 3,614,156 | 10/1971 | Sarvas . | |
| 3,674,311 | 7/1972 | Miller | 297/440.23 |
| 3,677,601 | 7/1972 | Morrison et al. | 297/441 |
| 3,695,690 | 10/1972 | Carson . | |
| 3,704,911 | 12/1972 | Milakovich . | |
| 3,822,079 | 7/1974 | Probber . | |
| 3,977,800 | 8/1976 | Cassel . | |
| 4,022,502 | 5/1977 | Smith . | |
| 4,285,544 | 8/1981 | Zapf . | |
| 4,291,999 | 9/1981 | Vandelanoite . | |
| 4,305,616 | 12/1981 | Matinez | 297/440.1 X |
| 4,523,787 | 6/1985 | Robinson . | |
| 4,602,817 | 7/1986 | Raftery | 297/440 |
| 4,711,495 | 12/1987 | Magder . | |
| 4,757,854 | 7/1988 | Rippberger | 160/391 |
| 4,798,416 | 1/1989 | Faust et al. | 297/218.2 X |
| 4,932,720 | 6/1990 | Sherman . | |
| 5,000,512 | 3/1991 | Laird . | |
| 5,069,506 | 12/1991 | Wieland . | |
| 5,080,438 | 1/1992 | Moyer . | |
| 5,265,939 | 11/1993 | Self et al. | 297/440.1 |
| 5,329,654 | 7/1994 | Sherman | 5/14 |

FOREIGN PATENT DOCUMENTS

| | | | |
|---|---|---|---|
| 1307103 | 9/1962 | France | 297/219.1 |
| 1320876 | 2/1963 | France | 297/219.1 |
| 1573865 | 6/1969 | France | 297/440.16 |
| 2436904 | 4/1980 | France . | |
| 1283660 | 12/1996 | France | 297/440.13 |
| 2156497 | 5/1973 | Germany . | |
| 1240234 | 7/1971 | United Kingdom . | |
| 1320715 | 6/1973 | United Kingdom | 297/440.1 |

OTHER PUBLICATIONS

Block House Advertisement, Pop Quiz.

*Primary Examiner*—Laurie K. Cranmer
*Attorney, Agent, or Firm*—Baker & Daniels

[57] ABSTRACT

A modular furniture assembly comprising interconnected frame, back, and arms. The frame has walls mounting the back and arms. The frame walls include flanges and the back and arms include slits, with each flange being slidably received in a corresponding slit to secure the back and arms to the walls. Another aspect involves the covering which is disposed over components of the modular furniture. A component body has an exterior surface over which a covering extends. The body includes a channel and the covering includes a strip having a size and shape approximately matching the internal contour of the channel. The strip easily slides into the channel to secure the covering over the outer contour, while the channel configuration prevents the movement of the strip except in the sliding direction.

18 Claims, 5 Drawing Sheets

MODULAR FURNITURE WITH INTERLOCKING COMPONENTS

BACKGROUND OF THE INVENTION

1. Field of the Invention

The present invention relates to furniture. More particularly, the field of the invention is that of modular furniture with removable covers.

2. Description of the Related Art

Modular furniture, sometimes also known as ready-to-assemble furniture, such as chairs or couches, is typically made by attaching two arms and a back to a base. The base, arms and back have a combined outer structure which looks similar to conventionally manufactured permanent furniture. The arms, back, and base components may include cushioning material or a surface to support a pillow. Modular furniture provides the advantage of minimizing the shipping space needed to transport the furniture. Being able to easily move the modular furniture by taking it apart is particularly important for situations which require frequent close quarter movement of the furniture.

Fabric is attached to the exterior of the components, either by permanently affixing the fabric to the component, or by removably attaching the fabric to the components with hook-and-loop fasteners. A modular furniture component with removably attached fabric covering provides for the additional advantages of easy transport and replacement of a soiled or damaged component. In addition, a modular furniture component with removable fabric covering arrangement allows for the components to be disassembled and the fabric detached for cleaning and/or replacement. This type of furniture is well suited for residential use or for college dormitory common areas and the like, allows for easy cleaning and variation of fabric colors and designs.

One known modular furniture design includes armrests having one of a plurality of styles attached to the seating component. In such a modular furniture design, such as a couch, back cushions are placed on top of the seat cushions and are leaned against a headrest; or, alternatively, the back cushions are attached to seat cushions via a generally L-shaped ladder back frame. The ladder back frame includes two upstanding portions which are received within a space formed in the bottom of the arm cushions. The arm cushions may have one of a plurality of exterior shapes, with the overall style and appearance of the article of furniture remaining the same.

A problem with conventional modular furniture, and particularly seating furniture, is that while certain designs may allow one or a few components of the article of furniture to be relatively easily assembled or disassembled, the resulting structure is relatively weak and is therefore subject to being damaged. Additional support may be added to these prior art designs, however, the additional support creates further difficulties for the assembly and disassembly of the modular furniture. Additional multiple fastening devices may be provided to support and hold the components together, but this increases the complexity of assembly or disassembly. Alternatively, the components may be enhanced to be self-supporting which greatly adds to their cost.

Another problem with modular furniture with removably detachable fabric covering is the difficulty in tautly disposing the detachable covering over some furniture contours so that the furniture resembles conventional furniture. For example, an arm rest may have an extending portion which projects beyond the plane defined by the side of the chair. In conventional assembled furniture, such an edge would be sewn or stapled to the frame. Fabric covering disposed over the edge between the side and the extending portion cannot be tautly drawn over that edge in modular furniture with removable covering because there is no location to affix the fabric. Although staples or glue could be used to securely attach the fabric covering, this would make removing the fabric cover problematic. A hook and loop connection may also be employed, but that type of connection tends to be displaced when people sit in the chair and apply stress on the hook and loop connection.

What is needed is a modular furniture design which is structurally secure without detracting from the assembly and disassembly or greatly increasing the cost. Also needed is a modular furniture design which retains the exterior fabric while allowing for easy removal.

SUMMARY OF THE INVENTION

The present invention relates to an improved modular furniture assembly wherein the arms and back are securely located relative to the frame. The back and arm components of the furniture assembly slide onto brackets of the frame, and edges of the back and arms mate to present an integral appearance. Also, the components of the modular furniture have covers extending over their exterior surfaces. The component bodies include a channel, and the covering includes a strip having a size and shape so that it can be slidingly inserted in the channel. The strip is disposed within the channel, and is capable of lateral movement within the channel. The strip secures an edge of the fabric covering which would otherwise not conform to the contour of the chair.

The interlocking of the arms and back with the frame brackets provide a supporting structure as secure as conventionally assembled permanent furniture. Once the arms and back are slid into the interlocking L-shaped bracket, the modular furniture looks and operates like conventional furniture. However, the arms and back may be slid out of engagement, and the covers of all the modular furniture components may be removed for cleaning or replacement. Once the cleaned or new covers are placed on the components, the strips may again be slid into the channels and the covering secured to the other components so that the chair may be used.

The strip of the fabric covering allows for the covering to be tautly disposed over the cushions or exterior surface of the furniture. The strip has sufficient width to form an interference with the channel and that interference fit of the strip in the channel provides a fixed position for an edge of the covering. The strip also allows for the covering to be easily changed by simply sliding the strip into and out of the channel. A channel may also be located on the back of a furniture piece, so that a strip on the covering of a cushion may be accurately located on the back over the frame, such as in a sofa or similar piece of furniture.

The present invention, in one form, is a modular furniture assembly comprising a frame, a back, and two arms. The frame has a plurality of walls. The back is mounted on a first wall, and the two arms are mounted on respective second and third walls. The back and arms are slidingly engaged witch the frame to interlock the back, arms, and frame.

An additional aspect of the inventive modular furniture assembly involves the covering over the exterior surface of components of the furniture. A body of a modular furniture component has an exterior surface and includes a channel.

The covering extends over a portion of the exterior surface. The covering also includes a strip having a size and shape approximately matching the internal contour of the channel. The strip is disposed within the channel, and is capable of lateral movement within the channel. The strip has sufficient width to form an interference with the channel.

One advantage of the present invention is that it provides a structurally secure modular furniture design.

Another advantage of the present invention is that it secures the removable fabric covering to the furniture at edges of the furniture.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
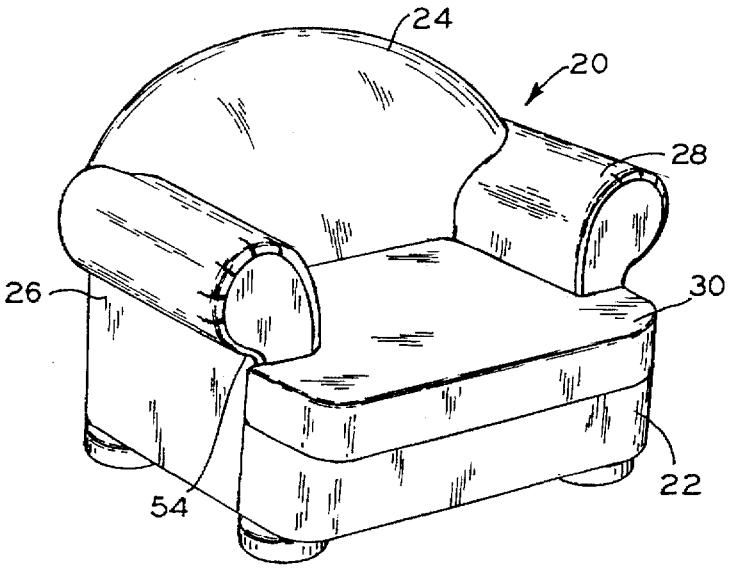
FIG. 1 is a perspective view of a chair made in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, in several forms, and such exemplifications are not to be construed as limiting the scope of the invention in any manner.

DESCRIPTION OF THE PRESENT INVENTION

The embodiments disclosed below are not intended to be exhaustive or limit the invention to the precise forms disclosed in the following detailed description. Rather, the embodiments are chosen and described so that others skilled in the art may utilize their teachings.

Figure 2:
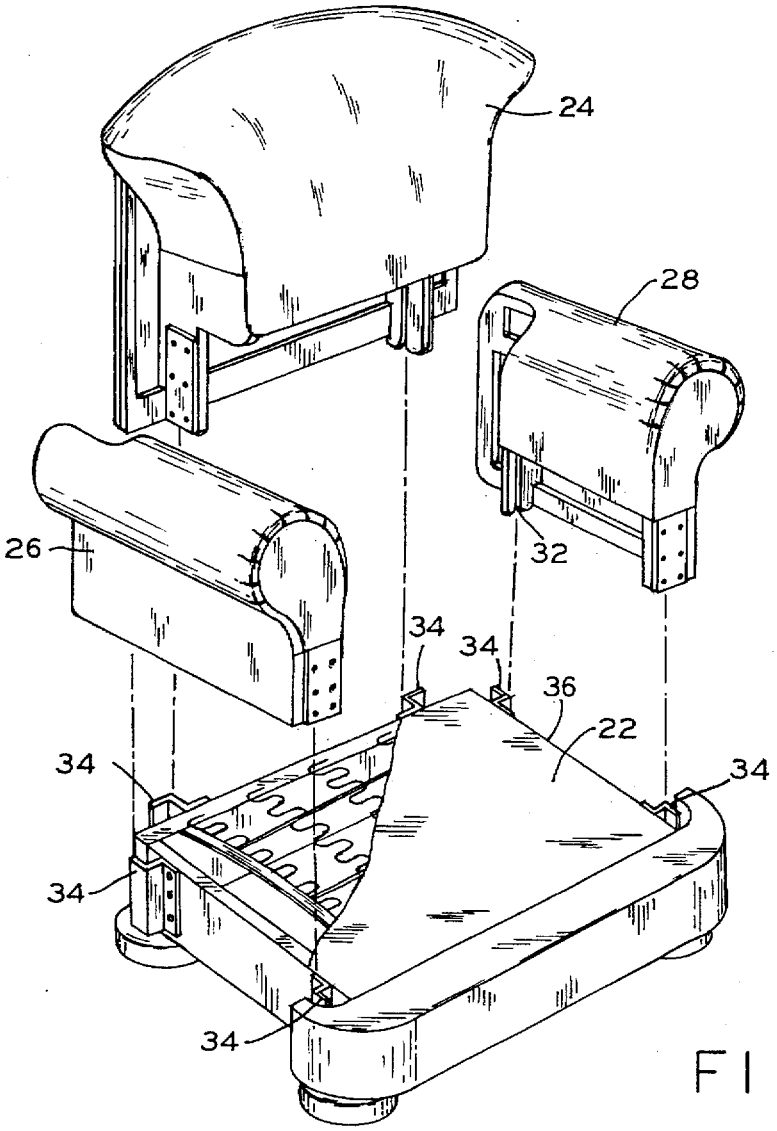
FIG. 2 is an exploded view of the chair of FIG. 1.
Figure 3:
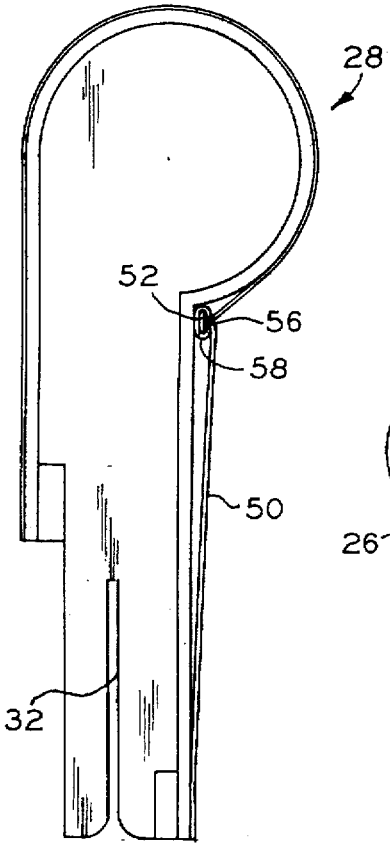
FIG. 3 a front view of an arm of the chair of FIG. 1.

Modular chair 20 of FIG. 1 includes frame 22, back 24, arms 26 and 28, and seat cushion 30. FIG. 2 shows an exploded view which aligns back 24, and arms 26 and 28 as they would be assembled onto frame 22. The actual assembly steps can be better understood with reference to FIGS. 4 and 5 which show partially assembled views of chair 20. The interlocking structure of arm 28 is shown in FIG. 3, while a bottom view of the frame structure to which arm 28 mounts is shown in FIG. 6.

Figure 4:
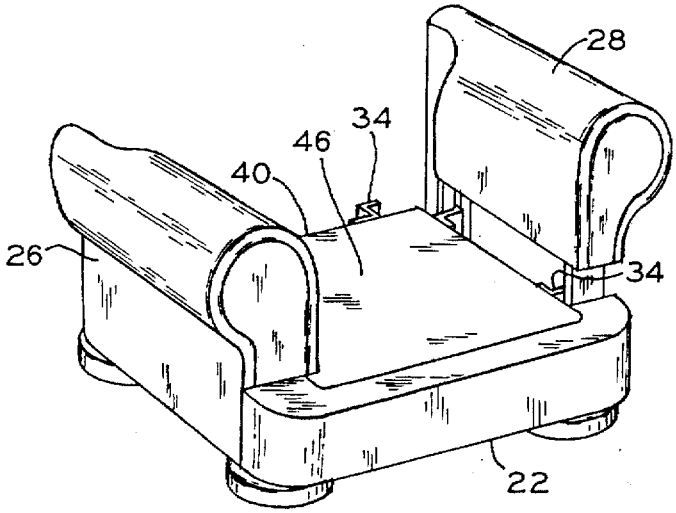
FIG. 4 is a perspective view of the arms engaging the frame.

In accordance with the present invention, back 24, arms 26 and 28 interlock with frame 22 through positive engagement. Slot 32 of arm 28 has a sufficient width to receive L-shaped bracket 34 which extends from sidewall 36 of frame 22. Arm 26 is a mirror image of arm 28 in this embodiment, although other arm contours and structures would be possible to provide the required interconnection provided by the present invention. By slot 32 slidably engaging bracket 34, arm 28 and frame 22 are interlocked. Arm 26 is similarly interlocked with frame 22 as shown in FIG. 4. Back 24 has slots 38 which similarly interlocks with brackets 34 located on sidewall 40 of frame 22.

Figure 5:
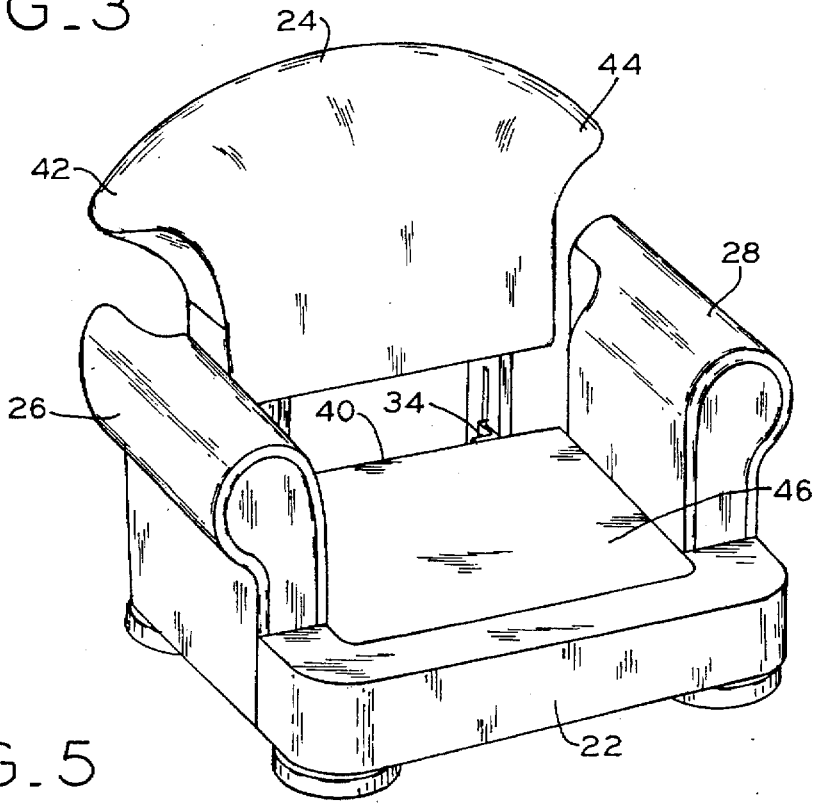
FIG. 5 is a perspective view the back engaging the frame.
Figure 6:
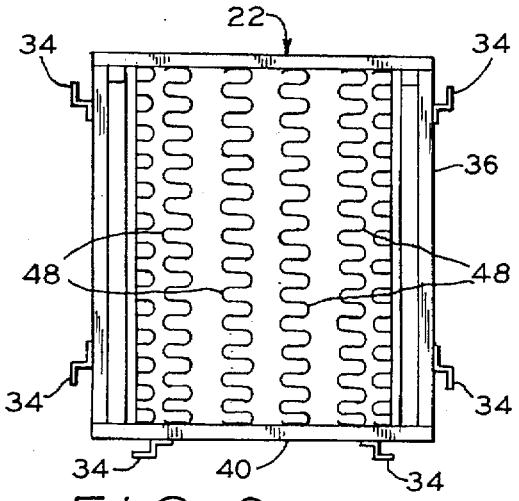
FIG. 6 is a bottom view of the frame of FIG. 2.

In the exemplary embodiment shown in FIG. 5, back 24 has a matching contour which meshes over arms 26 and 28 when they are interlocked with frame 22. Because of back overlay portions 42 and 44 in this embodiment, back 24 must be assembled after the interlocking of arms 26 and 28 with frame 22. However, equally possible alternative arrangements may include the arms having overlay portions, requiring that the back be assembled first, or no overlay portions allowing assembly in any order.

Once back 24 and arms 26 and 28 are secure, seat cushion 30 is placed on support 46 of frame 22. Frame 22 has springs 48 to resiliently prop support 46 so that seat cushion 30 has additional elasticity for the occupant.

Figure 7A:
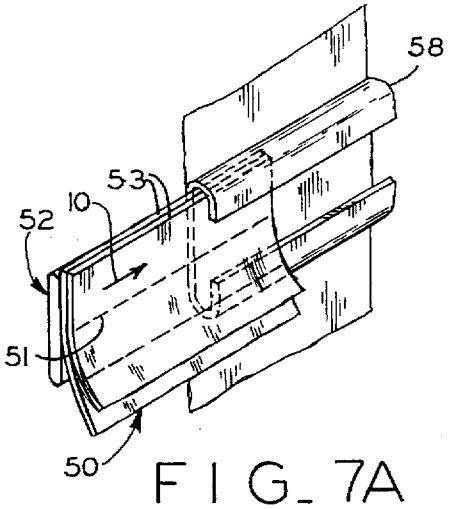
FIGS. 7A and 7B are perspective views of a strip being positioned within a channel.
Figure 7B:
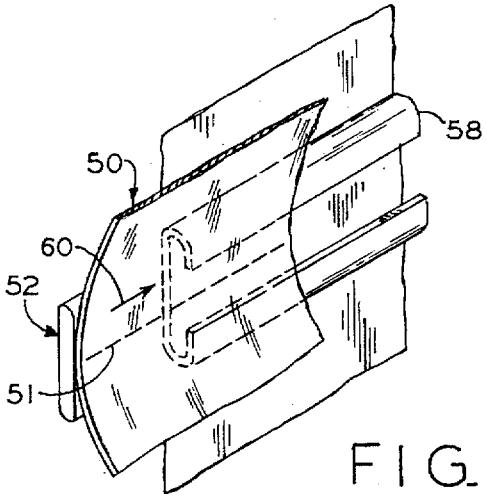
Figure 9:
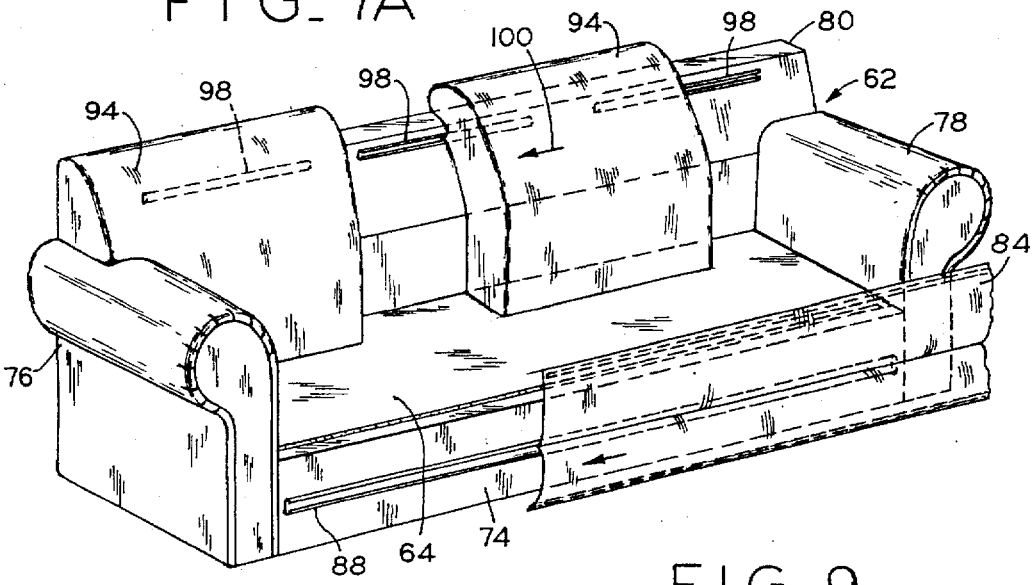
FIG. 9 is a perspective view of the back cushion and covering arrangement of the sofa of FIG. 8.
Figure 8:
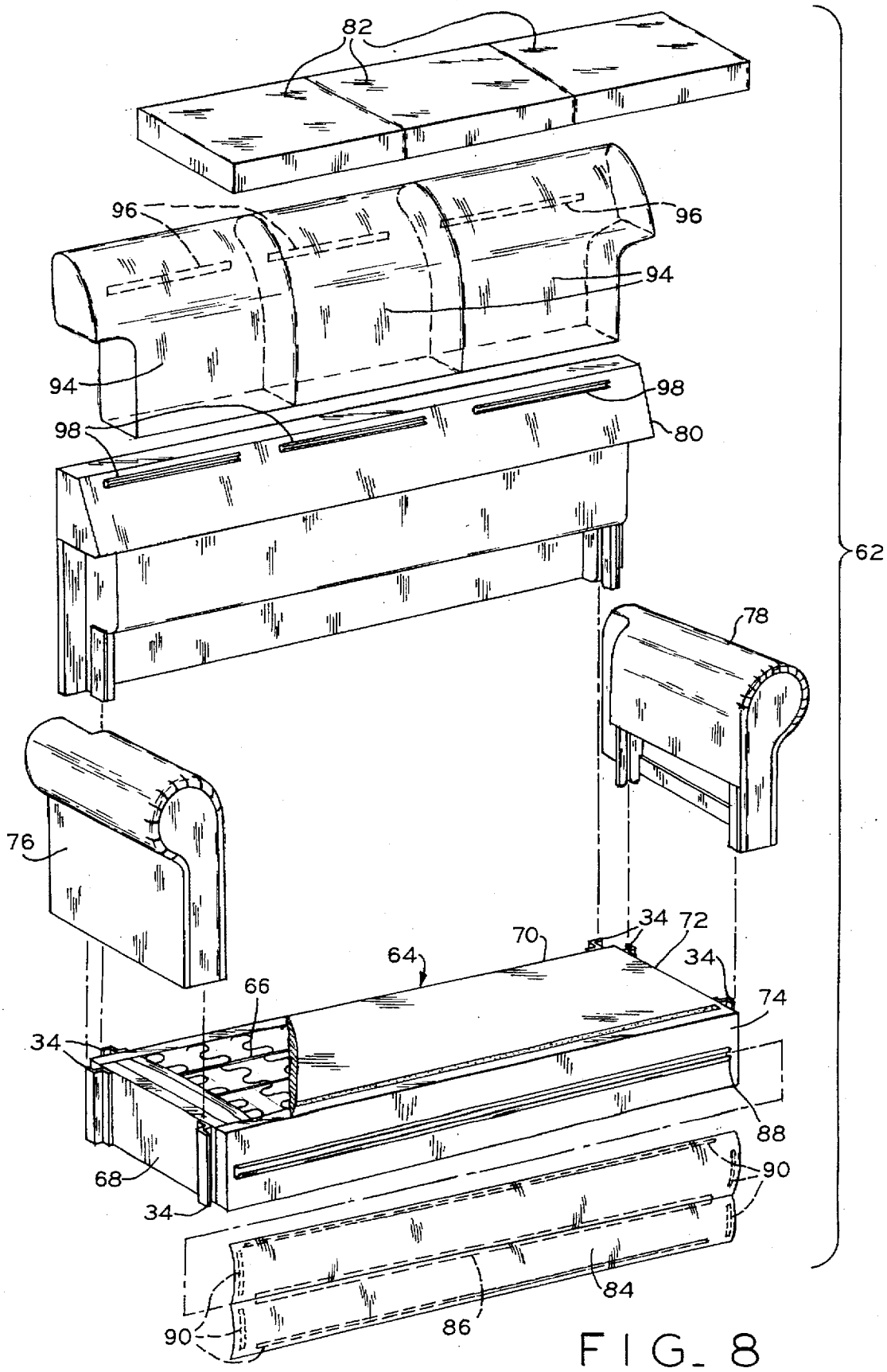
FIG. 8 is an exploded view of a sofa made in accordance with the present invention.

In accordance with another aspect of the present invention, fabric covering 50 includes strip 52 for connecting fabric covering 50 along a concave edge of a component of furniture (e.g., edge 54 on arm 26 or edge 56 of arm 28, see FIGS. 1 and 3). However, the arrangement described below may also be used on back or other components of furniture as well, such as a highlight of a front panel or to attach cushions (See FIGS. 8 and 9). Strip 52 is disposed in channel 58 of a component of modular furniture, for example arm 26 (FIG. 3), front panel 74 of sofa 62 (FIGS. 8 and 9), or back 80 of sofa 62 (FIGS. 8 and 9). Channel 58 is shaped and elongated to receive strip 52, for example with the C-shaped configuration shown in the drawings, although configurations having open ends may also be used. In FIG. 7A, fabric covering 50 includes two separate pieces of fabric which are connected at location 51 of strip 52 by suitable means, e.g., sewing or gluing. Although FIG. 7A shows ends 53 of fabric covering 50 looped within channel 58, ends 53 of fabric covering 50 may be positioned outside of channel 58. Alternatively, fabric covering 50 may include a single piece of fabric which is sewn, glued, or otherwise attached at location 51 to strip 52 (FIG. 7B). The width of channel 58 is configured to match the width of strip 52 to allow for strip 52 to slide within channel 58 as shown. Alternatively, channel 58 may be configured to form an interference fit with strip 52.

Referring to FIG. 3, the forces pulling on strip 52 through fabric covering 50 pull in a direction which is transverse from the elongate direction of channel 58. Because of this orientation, the actual force applied to strip 52 in a direction directly out of channel 58 is minimal. In order to install fabric covering 50 over arm 26 or front panel 74, strip 52 must be slid into channel 58 laterally, see FIGS. 7A and 7B. First, an end of strip 52 is located adjacent to an open end of channel 58 and is slid in the direction of arrow 60. Once strip 52 has traversed the entire length of channel 58, the ends of fabric covering 50 may be secured to arm 26 or front panel 74 conventionally, such as by a hook and loop connection. In this position, strip 52 is prevented from movement in a direction transverse to arrow 60.

The principles of the present invention may also be applied to other types of modular furniture, for example sofa 62 of FIGS. 8 and 9. Frame 64 includes spring support 66 surrounded by sidewalls 68, 70, 72, and 74. Brackets 34 are located on sidewalls 68, 70, and 72 to interlock with arms 76 and 78 as well as back 80, while support 66 supports seat cushions 82. Arms 76 and 78 and back 80 are interlocked with brackets 34 similarly to the interlocking of the first embodiment. Front sidewall 74 may have fabric shroud 84 disposed around its periphery, and shroud 84 may be attached by strip 86 engaging elongate channel 88 as described above in reference to FIGS. 7A and 7B, with conventional hook and loop fasteners 90 attaching shroud 84 about the edges of sidewall 74.

Back cushions 94 of sofa 62 include strips 96 which engage channels 98 located at an upper portion of back 80. As shown in FIG. 9, once strip 96 is aligned within channel 98, back cushion 94 is laterally moved in the direction of arrow 100. In their proper positions, strips 96 of back cushions 94 fill channels 98 and secure the positions of back cushions 94 relative to sofa 62.

Figure 10:
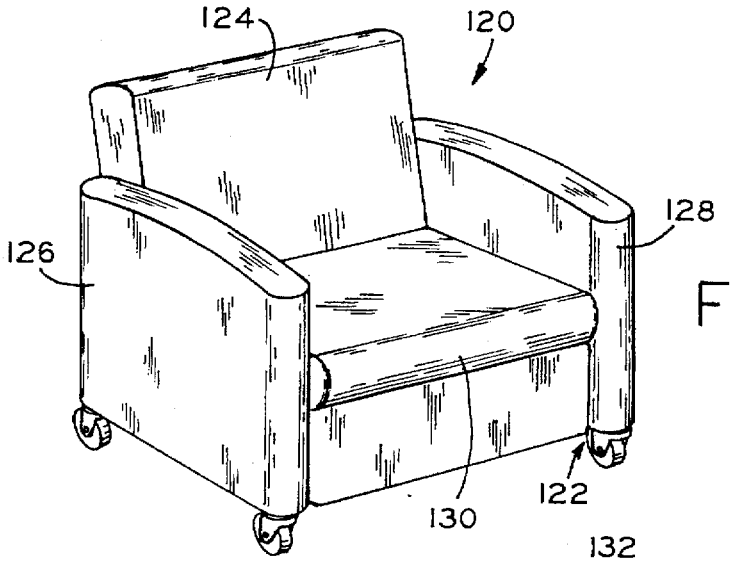
FIG. 10 is a perspective view of a second embodiment of a chair made in accordance with the present invention.
Figure 12:
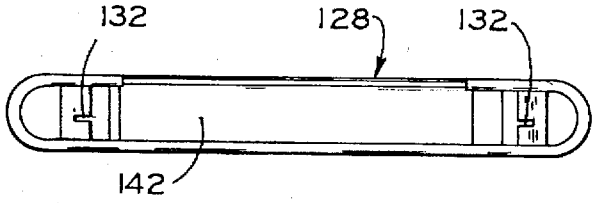
FIG. 12 is a bottom view of an arm component of the embodiment of FIG. 10.
Figure 11:
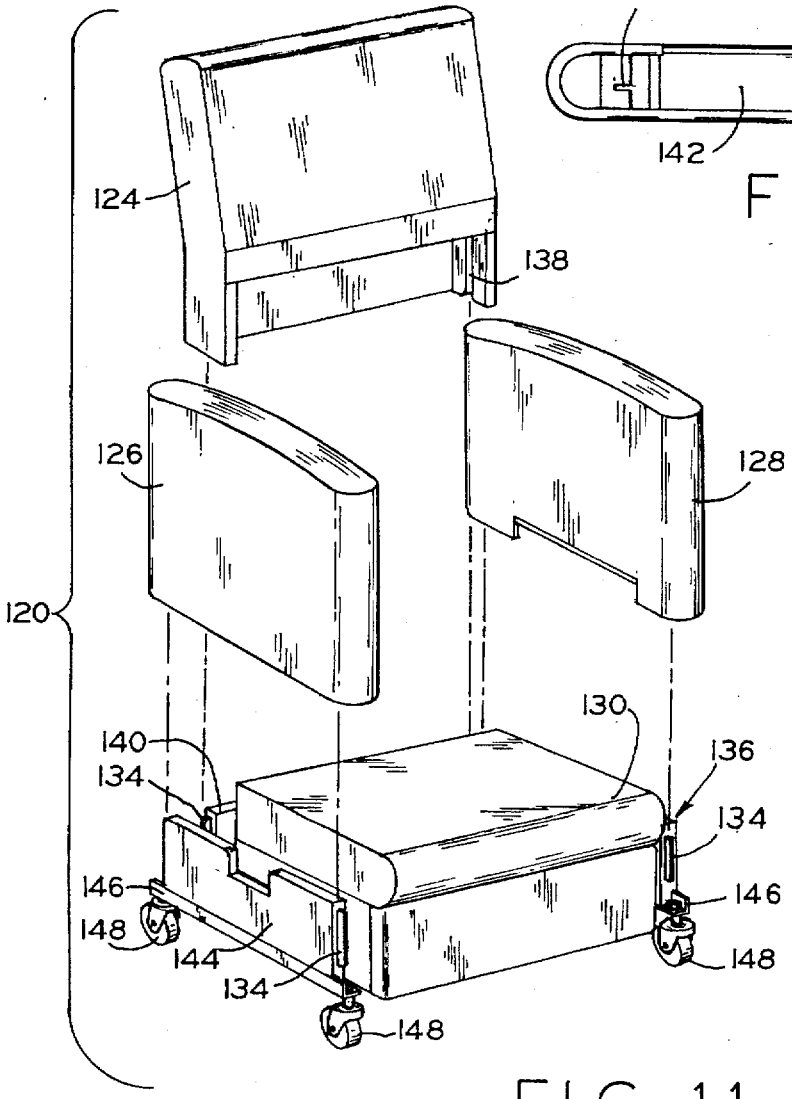
FIG. 11 is an exploded view of the chair of FIG. 10.

A second embodiment of a modular chair is shown in FIGS. 10–12 wherein movable modular chair 120 includes frame 122, back 124, arms 126 and 128, and seat cushion 130. FIG. 11 shows an exploded view which aligns back 124, and arms 126 and 128 as they would be assembled onto frame 122. The interlocking structure of arm 128 is shown in FIG. 3, which is substantially the same as the interlocking structure of arm 126 and back 124.

In accordance with the present invention, back 124, arms 126 and 128 interlock with frame 122 through positive engagement. Slot 132 of arm 128 has a sufficient width to receive flange bracket 134 which extends from sidewall 136 of frame 122. Arm 126 is a mirror image of arm 128 in this embodiment, although other arm contours and structures would be possible to provide the required interconnection provided by the present invention. By slots 132 slidably engaging flange brackets 134, arm 128 and frame 122 are interlocked. Back 124 has slots 138 which similarly interlocks with brackets 134 located on sidewall 140 of frame 122.

In this embodiment, arms 126 and 128 have interior regions 142 which receive sidewalls 144 and 136, respectively. Thus, arms 126 and 128 actually mount over flange brackets 134 and sidewalls 144 and 136 to further secure arms 126 and 128. Rather than having a box frame as in the earlier embodiment, frame 122 of this mobile furniture embodiment has rails 146 which support sidewalls 136 and 144. Rails 146 include rollers 148 which provide the mobility of mobile chair 120. Side wall 140, which supports back 124, is mounted on a rail (not shown) similar to rails 146, but which does not have rollers. This embodiment assembles in a manner similar to the earlier embodiment, although arms 126 and 128, and back 124, slide over their respective sidewall and flange rather than just the flange.

In the exemplary embodiment, the various furniture components are primarily made of wood, with steel "L" shaped flanges for interlocking with slits in the wooden structures. The fabric of the coverings generally may be made of any conventional suitable material. Strip 52 is made of a plastic material having a smooth surface, such as polypropylene, polyvinyl chloride, or alternatively may be made of a suitable metal surface. In the exemplary embodiment, strip 52 is 7/64 by ½ inches wide. If fabric is looped over strip 52, the strip is slightly wider, depending on the fabric thickness. Channel 58 is made of a plastic material having a smooth surface, such as polypropylene, polyvinyl choride, or alternatively a suitable metal, having dimensions of 9/32 by 11/16 inches.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A modular furniture assembly comprising:

a frame having a plurality of walls;

a back mounted on and surrounding a first wall of said frame;

first and second arms mounted on and surrounding respective second and third walls of said frame; and means for interlocking said back, said first arm, and said second arm with said frame, said interlocking means located within interior regions of said back and said first and second arms.

2. The modular furniture assembly of claim 1 wherein said interlocking means includes a flange extending from said frame and one of said back and said first and second arms includes a slit, said flange being received in said slit to secure said one of said back and said first and second arms on said one of said first, second, and third walls.

3. The modular furniture assembly of claim 2 wherein said slit is disposed at an angle relative to the corresponding one of said walls.

4. The modular furniture assembly of claim 1 wherein said back and said first and second arms extend to cover said first, second, and third walls of said frame.

5. The modular furniture assembly of claim 1 further comprising a covering, wherein one of said back, said arms, and said frame includes a body having an exterior surface, and said covering is disposed over said exterior surface, said body includes an elongate channel, and said covering includes a strip having a size and shape approximately matching the internal contour of said channel, said strip being slidably disposed within said channel, said strip being capable of movement in an elongate direction within said channel, and further including means for resisting movement of said strip within said channel in a direction which is transverse to said elongate direction.

6. The modular furniture assembly of claim 5 wherein said channel is disposed on said exterior surface.

7. The modular furniture assembly of claim 5 wherein said channel is disposed below said exterior surface.

8. The modular furniture assembly of claim 5 wherein said strip is attached to said covering.

9. The modular furniture assembly of claim 5 wherein said strip is connected to a loop of said covering.

10. The modular furniture assembly of claim 1 wherein said frame includes a plurality of springs supporting a cushion.

11. A modular furniture assembly comprising:

a frame having a plurality of walls; and a plurality of support components mounted on and surrounding respective ones of said walls;

each said support component having a leg with an elongate slit located within an interior region of said support component, said frame including a plurality of L-shaped brackets corresponding to said plurality of support components, said leg elongate slit slidably engaging a corresponding one of said L-shaped brackets to interlock said support component with said frame so that said L-shaped bracket supports and vertically aligns said support component.

12. The modular furniture assembly of claim 11 wherein said slit is disposed at an angle relative to the corresponding one of said walls.

13. The modular furniture assembly of claim 11 wherein said support components extend to cover said frame.

14. The modular furniture assembly of claim 13 further comprising a front panel covering portions of said frame not covered by said support components.

15. The modular furniture assembly of claim 11 further comprising a covering, wherein one of said support components and said frame includes a body having an exterior surface, and said covering is disposed over said exterior surface, said body includes an elongate channel, and said covering includes a strip having a size and shape approximately matching the internal contour of said channel, said strip being slidably disposed within said channel, said strip being capable of movement in an elongate direction within said channel, and further including means for resisting movement of said strip within said channel in a direction which is transverse to said elongate direction.

16. The modular furniture assembly of claim 15 wherein said channel is disposed on said exterior surface.

17. The modular furniture assembly of claim 15 wherein said channel is disposed below said exterior surface.

18. The modular furniture assembly of claim 15 wherein said strip is attached to said covering.

* * * * *